US006807970B2

(12) United States Patent
Thayer

(10) Patent No.: US 6,807,970 B2
(45) Date of Patent: Oct. 26, 2004

(54) EYELASH PROFILER

(75) Inventor: Jonathan Thayer, Nutley, NJ (US)

(73) Assignee: E-L Management Corp., New York, NY (US)

( * ) Notice: Subject to any disclaimer, the term of this patent is extended or adjusted under 35 U.S.C. 154(b) by 0 days.

(21) Appl. No.: 10/292,572

(22) Filed: Nov. 12, 2002

(65) Prior Publication Data

US 2004/0089319 A1 May 13, 2004

(51) Int. Cl.[7] ..... A45D 24/00
(52) U.S. Cl. ..... 132/200
(58) Field of Search ..... 132/216, 213, 132/214, 285, 319, 200; 33/200, 507, 511, 512

(56) References Cited

U.S. PATENT DOCUMENTS

| | | | | |
|---|---|---|---|---|
| 1,873,928 A | | 8/1932 | Bohner | 132/216 |
| 1,907,476 A | | 5/1933 | Ballard et al. | 132/216 |
| 1,974,825 A | | 9/1934 | Lovie | 132/1 |
| 2,260,614 A | | 10/1941 | Freitas | 132/88.5 |
| 3,557,653 A | * | 1/1971 | Kim | 132/216 |
| 3,789,856 A | | 2/1974 | Bomba | 132/88.5 |
| 3,884,232 A | | 5/1975 | Braun | 128/260 |
| 4,033,364 A | | 7/1977 | Inzana et al. | 132/88.5 |
| 5,178,170 A | | 1/1993 | Kassai | 132/319 |
| 5,311,888 A | | 5/1994 | Leigh | 132/319 |
| 5,890,499 A | | 4/1999 | Fuentes et al. | 132/319 |
| 6,305,389 B1 | | 10/2001 | Bakken | 132/319 |

* cited by examiner

*Primary Examiner*—John J. Wilson
*Assistant Examiner*—Robyn Doan
(74) *Attorney, Agent, or Firm*—Martin W. Haerter

(57) ABSTRACT

A printed template and method for using the template are illustrated for evaluating various characteristics of eyelashes and categorizing the eyelashes accordingly. The template has one edge portion suitable for placement adjacent an eyelid under eyelashes. The edge portion is provided with indicia representing known eyelash characteristics such as density, thickness, length or color. The indicia on the template are placed adjacent actual eyelashes such that a visual comparison can be made between the eyelashes and the indicia. By comparing the eyelashes to the indicia, a user can more objectively determine the measurements and characteristics of the eyelashes.

4 Claims, 3 Drawing Sheets

EYELASH PROFILER

BACKGROUND OF THE INVENTION

1. Field of the Invention

This invention relates to a device and method for gauging and profiling the physical characteristics of eyelashes, such as, for example, the density, thickness and length of eyelashes. In particular, the device facilitates the determination of an individual user's eyelash characteristics so that the user can, for example, select a mascara applicator and mascara product suitable for those eyelash characteristics.

2. Description of the Prior Art

Mascara, an important part of the contemporary cosmetic arsenal, is available in many different formulations, with varying viscosity, solvents, fiber content, pigments, etc. Applicators for coating eyelashes with mascara also are available in many different constructions and styles, e.g., brushes with varying bristle lengths, density and properties, disk applicators, etc. There is also great variety in the characteristics of human eyelashes, e.g., thickness (diameter) of individual lashes, density (number of lashes per millimeter), length of lashes, etc. Because of this diversity in eyelashes, mascara products and product applicators, it is often difficult for consumers to choose a product and applicator best suited for their particular eyelash characteristics. Consumers often do not know objectively what relative eyelash characteristics they may have, and thus what products would be suitable for those eyelash characteristics. So mascara products and product applicators are commonly selected by trial and error.

Devices for aiding in the application of mascara to eyelashes are well known. Such devices are disclosed in, for example, in U.S. Pat. Nos. 3,884,232, 1,873,928, 1,907,476, 1,974,825, 3,789,856, 2,260,614 and 4,033,364. These devices are said to be useful in preventing smudging or mis-application of eye makeup. However, none of these devices provide any means or method for profiling the particular eyelash characteristics of a user.

BRIEF SUMMARY OF THE INVENTION

The present invention provides a convenient and inexpensive device for profiling eyelashes. A template is provided with indicia on one edge portion. The indicia represent known eyelash characteristics. To gauge the particular characteristics of a person's eyelashes, a user places the indicia under the eyelashes and visually compares the eyelashes to the indicia. By visual observation, a user can conveniently and objectively determine, for example, if the eyelashes have a greater or lessor thickness, length and density relative to the known mean measurements represented by the indicia. This information along with secondary information provided to the consumer by way of the template may be used by the consumer to select the appropriate mascara formula and/or product applicator.

DETAILED DESCRIPTION OF THE INVENTION

Figure 1:
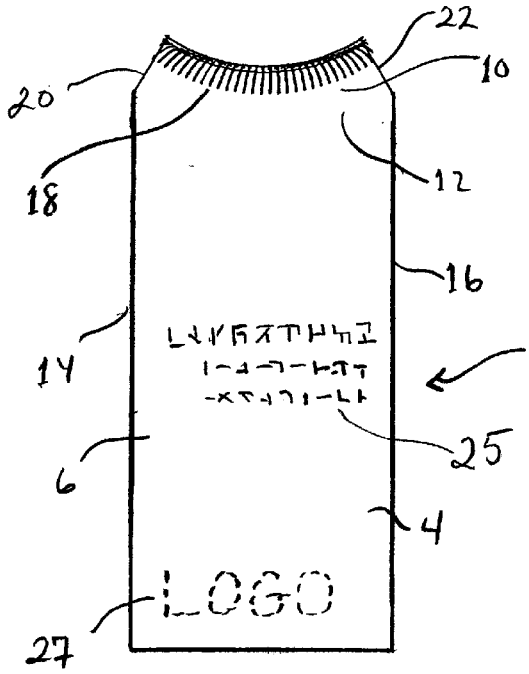
FIG. 1 is a top plan view of one embodiment of the invention.
Figure 2:
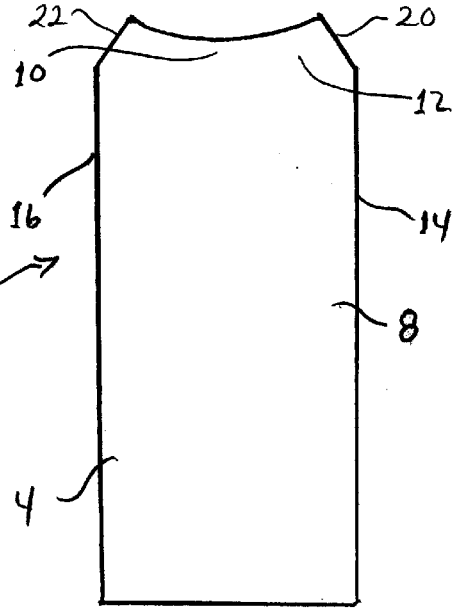
FIG. 2 is a bottom plan view of the embodiment shown in FIG. 1.
Figure 3:
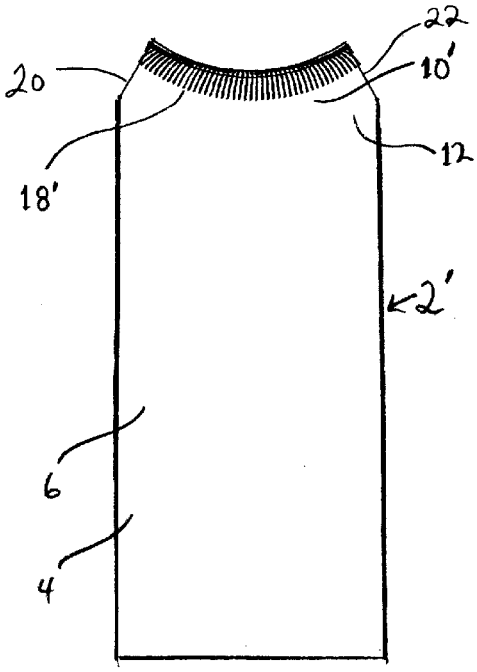
FIGS. 3–6 are plan views of alternative embodiments of the invention.
Figure 4:
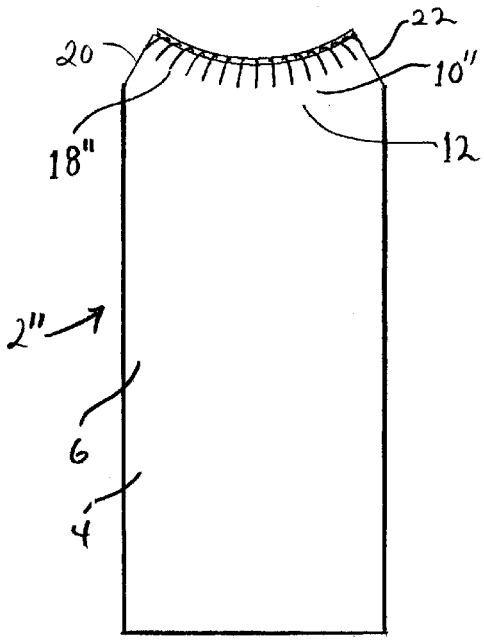
Figure 7:
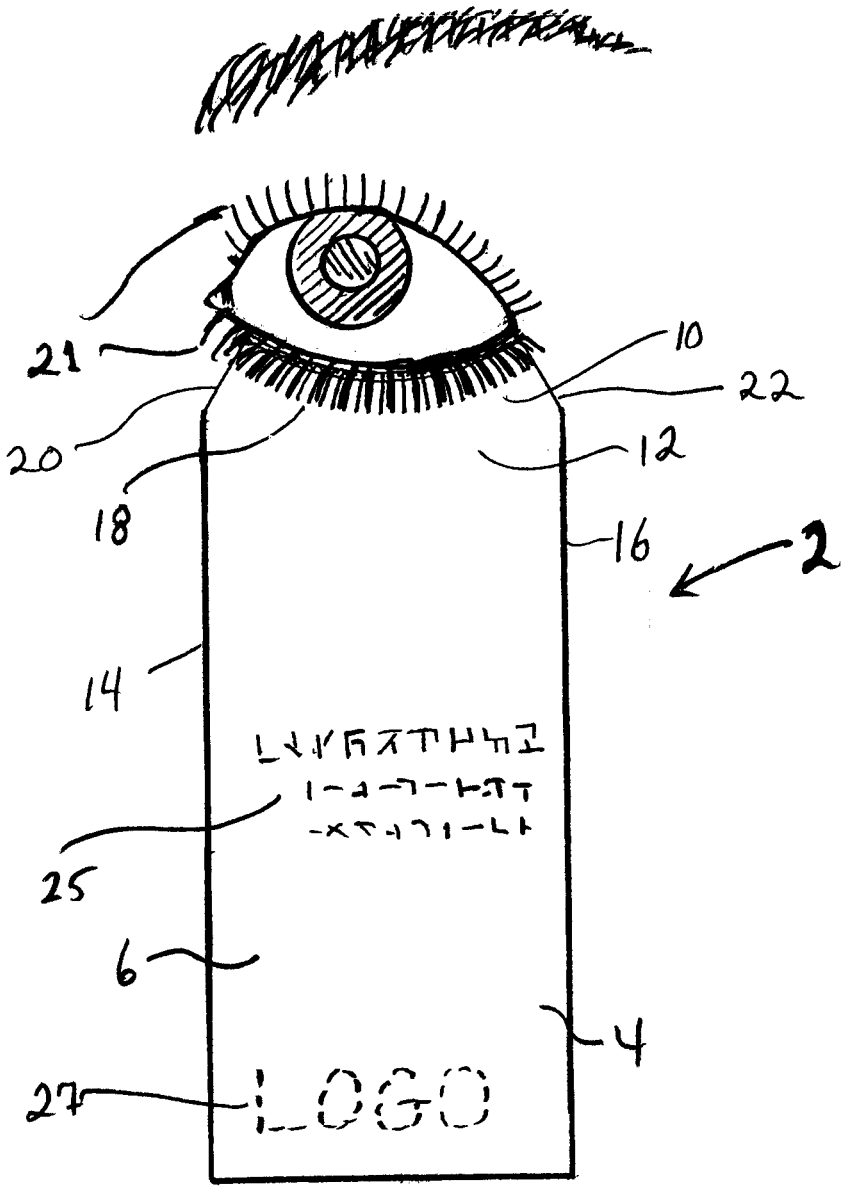
FIG. 7 is a view of the embodiment shown in FIG. 1 positioned for use.

Referring to FIGS. 1, 2 and 7, a device or template 2 for profiling eyelashes is illustrated that consists of a sheet 4 having a top surface 6, a bottom surface 8 and at least one edge portion 10 at a first end 12 of the sheet 4. The edge portion 10 is dimensioned for placement near an eyelid proximal to the base of a user's eyelashes. By this, it is meant that the edge portion is preferably dimensioned to approximate the width of a human eye. In the preferred embodiments shown in FIGS. 1–4 and 7, this is accomplished by providing the sheet 4 with an overall width from a side 14 to a side 16 that approximates the width of a human eye. In addition, at least one side 20 or 22 of the edge portion 10 may be tapered to better accommodate the shape of an eyelid and surrounding anatomy, e.g., the bridge of the nose, and to minimize sharp angles that could irritate a user. Where the width of the sheet from side 14 to side 16 is greater than the approximate width of a human eye, the edge portion 10 may be positioned adjacent to one of side 14 or side 16, as illustrated by the embodiment shown in FIG. 5, for example. In other words, the edge portion 10 is positioned at or close to one corner of the sheet 4, so that the edge portion 10 can be placed near the eyelid without interference from the bridge of a user's nose. Preferably, as shown in FIGS. 1, 2 and 7, the edge portion 10 is inwardly curved to cooperatively register with the convexly curved anatomy of the eyelid as illustrated in FIG. 7.

First indicia 18 are provided on at least one of the top surface 6 or the bottom surface 8 in the edge portion 10. The indicia are comprised of individual lines, some of which are curved, that mimic the appearance of actual eyelashes as closely as can be accomplished in a flat representation (i.e., in two dimensions). The indicia 18 are dimensioned to gauge at least one eyelash characteristic, such as, for example, the thickness of individual lashes, the density of the eyelashes, the length of the eyelashes, or the color of the eyelashes. In particular, the indicia simulate known characteristics of different types of eyelashes, allowing a user to visually compare actual eyelashes with the indicia to determine relatively objectively what the characteristics of the actual eyelashes are. For example, adult human eyelashes commonly range in thickness (i.e., diameter of individual eyelash shafts) from about 0.05 mm to about 0.20 mm, in length from about 2 mm to about 15 mm, and in density (i.e., the number of lashes per centimeter) from about 10 lashes per cm to about 30 lashes per cm. In FIG. 1, the indicia 18 may represent, for example, a mean diameter of 0.10 mm, a mean length of 10 mm and a mean density of 20 lashes per cm for adult humans. By placing the template 2 under eyelashes 21 as shown in FIG. 7 and visually comparing the actual eyelashes 21 to the mean dimensions represented by indicia 18 in FIG. 1, a user can conveniently and objectively determine, for example, if the actual eyelashes 21 have a greater or lessor thickness, length and density relative to the known mean measurements represented by indicia 18. In FIG. 7, the eyelashes 21 illustrated are approximately the same thickness and length as the indicia 18, but are of a lessor density than the indicia 18. This is readily apparent as the actual eyelashes 21 illustrated only overlap approximately half of the representative indicia 18. Thus, by visual observation, it can be determined that the illustrated eyelashes 21 are medium thickness, medium length lashes having a sparse density. This information can then be used to select, for example, a mascara formula and product applicator suitable for such eyelash characteristics.

With respect to color, by providing indicia on an edge portion in a particular shade of human hair color, e.g., blonde, brunette, black, auburn (red) or gray, the shade of actual eyelashes can be relatively objectively determined by comparison with the colored indicia. This information can be used, for example, to select a suitable shade of mascara.

Figure 5:
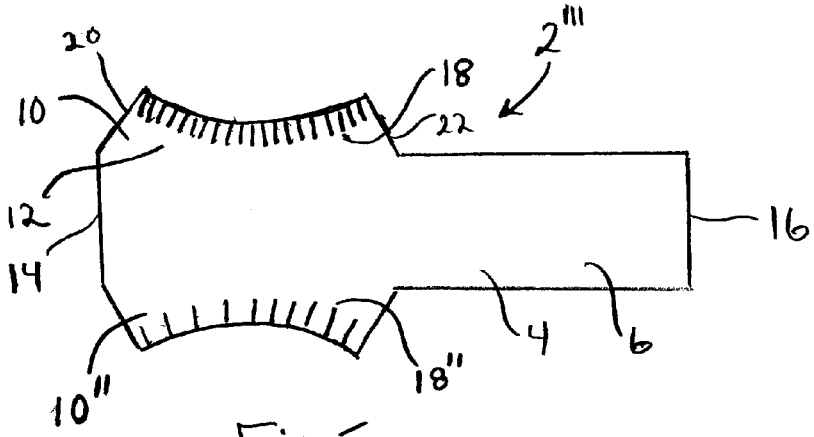
Figure 6:
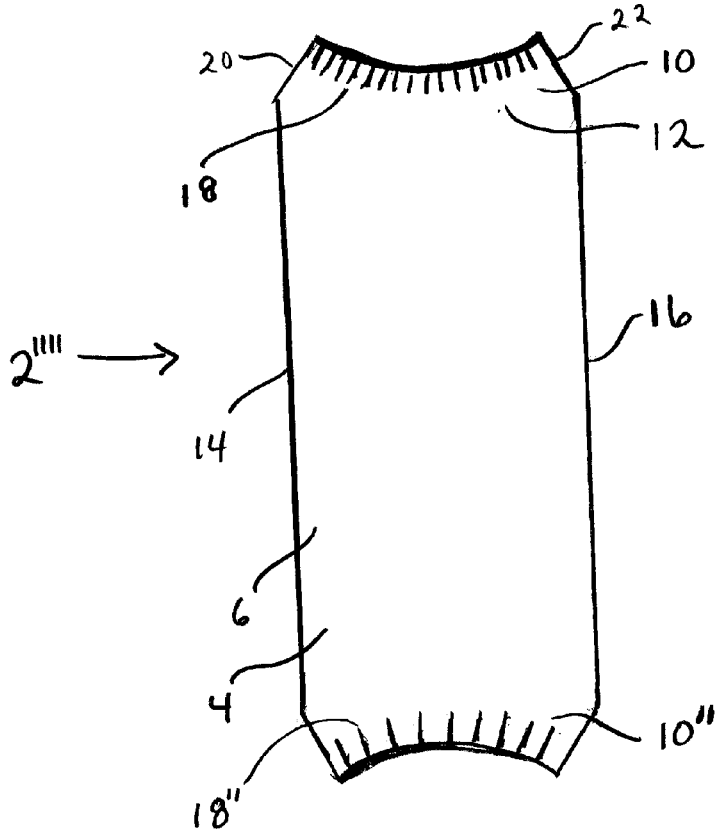

To better quantify the characteristics of actual eyelashes, rather that providing only one edge portion 10 with mean characteristic dimensions as described above, two or more edge portions can be provided, each with different known eyelash characteristics to compare to actual eyelashes. For example, a first template 2' may be provided with an edge portion 10' having indicia 18' (FIG. 3) representing minimum eyelash dimensions, and a second template 2" may be provided with an edge portion 10" having indicia 18" (FIG. 4) representing maximum eyelash dimensions. Thus, indicia 18' on template 2' would represent a thickness of 0.05 mm, a length of 2 mm and density of 10 lashes per cm, and indicia 18" on template 2" would represent a thickness of 0.20 mm, a length of 15 mm and density of 30 lashes per cm. By placing in consecutive steps the templates 2' and 2" under eyelashes and visually comparing the eyelashes to the minimum and maximum dimensions represented by indicia 18' and 18", a user can determine the characteristics of the eyelashes relative to those minimum and maximum dimensions. While the foregoing example illustrates the method of evaluating and characterizing eyelashes with two templates 2' and 2", it will be understood that any number of templates, each having indicia representing different known eyelash characteristics or dimensions, can be used to evaluate eyelashes. In the foregoing illustration, for example, template 2 (FIG. 1) having indicia 18 representing mean eyelash dimensions could be used to further categorize and classify the characteristics of the eyelashes being evaluated. It will also be understood that more than one edge portion may be provided to a single template 2, as illustrated for example in FIGS. 5–6 showing edge portions 10 and 10". While it is contemplated that more than one edge portion 10, 10" with indicia can be provided on a single sheet 4 as shown for example in FIGS. 5–6, for sanitary reasons the preferred embodiment shown in FIG. 1 has only one edge portion. This avoids contamination of an eye by contact with an edge portion 10' that has previously been contaminated by contact with a user's fingers or another eye.

The template 2 may further include second indicia 25, 27 (FIGS. 1 and 7) on at least one of the top surface 6 or the bottom surface 8, positioned such that it does not interfere with the eyelash profiling/gauging first indicia 18. The second indicia 25, 27 provide supplemental information such as, for example, a product logo or trademark 27, product promotional information, product or applicator recommendations for various eyelash characteristics, a website address for more information, etc. The supplemental information provided in the second indicia can generate substantial interest in the device, thus significantly increasing its appeal and desirability.

The template 2 can be readily and economically produced from commonly available paper or paperboard sheet stock printed with commonly available inks and trimmed in well known processes. Preferably, the sheet stock is of sufficient thickness, and the trim and finish steps are selected, to avoid sharp edges that could cut or irritate the eye or the sensitive skin of the eyelid. Also, the sheet stock and any inks or dyes used to color or print on the template 2 should be biocompatible to avoid irritation or injury to the user.

As described above and illustrated in FIG. 7, the method for profiling eyelash types comprises the steps of providing an edge portion 10 of a sheet with indicia 18 representing at least one selected eyelash characteristic; placing the edge portion 10 under eyelashes 21 such that the eyelashes can be compared to the indicia 18; and visually comparing the characteristics of the eyelashes to the indicia to determine the eyelash profile of the eyelashes relative to at least one eyelash characteristic represented by the indicia.

Alternatively, the method for profiling eyelash types comprises the steps of providing on a first sheet a first edge portion with first indicia representing at least a first selected eyelash characteristic value; providing on the first sheet or on a second sheet a second edge portion with second indicia representing at least a second selected eyelash characteristic value different from the first eyelash characteristic value; placing the first edge portion under eyelashes such that the eyelashes can be compared to the first indicia, and visually comparing the characteristics of the eyelashes to the first indicia; removing the first edge portion and placing the second edge portion under eyelashes such that the eyelashes can be compared to the second indicia, and visually comparing the characteristics of the eyelashes to the second indicia; and determining an eyelash profile for the eyelashes based on relative similarity to or differences with the first indicia and second indicia. In the alternative method, the first edge portion 10 and the second edge portion 10" may both be on the same template (see, for example, 2'" and 2"" in FIGS. 5–6), or the first edge portion 10 and second edge portion 10" may be on separate templates (see, for example, 2 and 2" in FIGS. 1 and 4, respectively).

The advantages of the present invention are readily apparent. The template of the present invention provides a baseline by which consumers can relatively objectively determine the characteristics of their eyelashes. This information can then be used to select a mascara product and/or product applicator best suited for the user's eyelash characteristics. With this information, the user and the product marketer can minimize or totally avoid the undue burden and expense of trial and error experimentation.

Furthermore, because of the simple structure of the template 2, and because it is made by well known processes from readily available materials, the cost of producing the template 2 is extremely low. While the cost is low, the template 2 serves the important function to consumers of profiling lashes to aid in selection of suitable makeup products. Additionally, the template may provide secondary product information. Thus, the template may be used as an important marketing and promotional tool. With simple construction and low production cost, the template is ideally suited for a single use, disposable applications, thus facilitating hygienic and sanitary conditions in, for example, a retail setting such as a cosmetic sales counter. The low cost also makes it possible for the template to be used very effectively as a promotional tool that can be distributed to consumers for free along with product information or a marketing or other message. In addition to retail distribution points, such as cosmetic sales counters, the template can readily be distributed in well known promotional channels, such as, for example, direct mail promotions, magazine and newspaper inserts, inserts in the packaging of related cosmetic products, etc. The simplicity and excellent function of the invention would even permit distribution as a downloadable and printable image on a website. An interested consumer could print the image, and with a pair of scissors trim excess paper from the perimeter of the image to yield a functional template.

While the invention has been described and illustrated as embodied in preferred forms of construction, it will be understood that various modifications may be made in the structure and arrangement of the parts without departing from the spirit and the scope of the invention recited in the following claims.

What is claimed is:

1. A method for profiling eyelash types comprising:

providing an edge portion of a sheet with indicia representing at least one selected eyelash characteristic selected from a thickness, a density, a length and a color of eyelashes;

placing the edge portion under eyelashes such that the eyelashes can be compared to the indicia; and visually comparing the characteristics of the eyelashes to the indicia to determine the eyelash profile of the eyelashes relative to the at least one selected eyelash characteristic represented by the indicia.

2. A method for profiling eyelash types comprising the steps of:

providing on a first sheet a first edge portion with first indicia representing at least a first selected eyelash characteristic value;

providing on the first sheet or on a second sheet a second edge portion with second indict a representing at feast a second selected eyelash characteristic value different from the first eyelash characteristic value;

placing the first edge portion under eyelashes such that the eyelashes can be compared to the first indicia, and visually comparing the characteristics of the eyelashes to the first indicia;

placing the second edge portion under eyelashes such that the eyelashes can be compared to the second indicia, and visually comparing the characteristics of the eyelashes to the second indicia; and determining an eyelash profile for the eyelashes based on relative similarity to the first indicia or second indicia.

3. The method of claim 2 wherein the first edge portion and the second edge portion are on the first sheet.

4. The method of claim 2 wherein the first edge portion is on the first sheet and the second edge portion is on the second sheet.

* * * * *